United States Patent [19]

Key

[11] 4,453,572

[45] Jun. 12, 1984

[54] METHOD AND APPARATUS FOR WASTE SELVAGE REMOVAL

[75] Inventor: Worth M. Key, Hurt, Va.

[73] Assignee: Burlington Industries, Inc., Greensboro, N.C.

[21] Appl. No.: 401,694

[22] Filed: Jul. 26, 1982

[51] Int. Cl.[3] ..... D03D 49/70; D03D 17/40

[52] U.S. Cl. ..... 139/302; 139/291 C; 139/430

[58] Field of Search ..... 139/302, 194, 291 C, 139/430, 1 C; 66/145 S, 147; 26/10.4, 96

[56] References Cited

U.S. PATENT DOCUMENTS

| | | | |
|---|---|---|---|
| 1,966,935 | 10/1932 | Pool . | |
| 2,247,244 | 6/1941 | Lawson . | |
| 2,906,296 | 10/1959 | Ancet et al. . | |
| 2,984,263 | 5/1961 | Loepsinger | 139/1 C |
| 3,094,855 | 6/1963 | Vossen . | |
| 3,174,515 | 8/1963 | Luber . | |
| 3,376,903 | 2/1966 | Golobart . | |
| 3,417,444 | 12/1968 | McCreary | 26/96 |
| 3,455,342 | 7/1967 | Golobart . | |
| 3,461,920 | 8/1969 | Sakamoto | 139/302 |
| 3,703,914 | 11/1972 | Freisler . | |
| 3,744,533 | 7/1973 | Yano et al. . | |
| 3,880,201 | 4/1975 | Lee, Jr. et al. . | |
| 4,171,008 | 11/1979 | Onishi et al. . | |
| 4,185,667 | 1/1980 | Kendrick . | |

FOREIGN PATENT DOCUMENTS

| | | | |
|---|---|---|---|
| 1199669 | 6/1959 | France | 26/10.4 |
| 50-20185 | 7/1975 | Japan | 139/291 C |
| 203613 | 12/1967 | U.S.S.R. | 139/291 C |

OTHER PUBLICATIONS

McGraw-Hill Encyclopedia of Technology "Vacuum Pump" article; 1960.

*Primary Examiner*—James Kee Chi

*Attorney, Agent, or Firm*—Cushman, Darby & Cushman

[57] ABSTRACT

Waste selvage containing warp ends or leno yarns interlaced with filling tails is removed from a shuttleless loom. The loom includes a suction source having an impeller pump with an exhaust, with fabric being removed by a fabric take-up roller. A venturi is disposed below the fabric take-up roller in operative association with waste selvage from fabric being taken up by the roller, the exhaust from the impeller pump being connected to the venturi to provide the motive power for the venturi to suck waste selvage through the venturi and deposit it in a waste selvage container. Draw-off wheels are provided between the venturi and the fabric take-up roller, the venturi preventing the selvage from clinging to the draw-off wheels, and being wound onto the wheels, without any energy penalty. A baffle at the venturi induces rotary turbulence to cause the filling tails and warp ends or leno yarns to twist together so the filling tails will not be blown away by air passing through the venturi.

14 Claims, 3 Drawing Figures

METHOD AND APPARATUS FOR WASTE SELVAGE REMOVAL

BACKGROUND AND SUMMARY OF THE INVENTION

Conventional shuttleless looms have waste selvages that are cut off from the edge of the fabric just prior to the fabric being taken up on a take-up roller, and it is necessary to provide some way to remove the waste selvage after cutting. A conventional prior art arrangement is illustrated in FIG. 1 of U.S. Pat. No. 4,185,667.

Typically, waste selvage removal is accomplished by providing a pair of draw-off toothed wheels that mesh together tightly enough to pull the waste selvage between them, away from the loom, and into a waste selvage container. When lightweight yarns are being woven, the waste selvage often clings to the draw-off wheels, and becomes wound onto the wheels. Eventually this results in the waste selvage breaking, which allows it to wrap around the fabric take-up roller, or become intertwined with the fabric take-up mechanism. Substantial down time of the loom may result.

According to the present invention, the drawbacks inherent in the prior art are overcome in an extremely simple manner which does not require substantial modification of the loom, and which does not result in additional energy usage.

According to the present invention, apparatus for removing waste selvage containing warp ends interlaced with filling tails from a shuttleless loom is provided. The loom includes a suction source having an impeller pump with an exhaust, a fabric take-up roller, and a selvage trimming mechanism. The waste selvage removal apparatus according to the invention comprises a substantially downwardly directed venturi mounted below the fabric take-up roller in operative association with waste selvage trimmed from fabric being taken up by the fabric take-up roller.

An open-top waste selvage container is disposed below the venturi. Exhaust conduit means extend from the impeller pump exhaust to the venturi for providing the motive power for the venturi to suck waste selvage through the venturi and deposit it in the waste selvage container. The exhaust conduit means includes a pneumatic line connected to the pump exhaust and a branch connector connected to the pneumatic line, one branch leading to the waste selvage container, and the other receiving the waste selvage from between the draw-off wheels. A baffle means is provided at the branch for creating a rotary turbulence to twist waste selvage so that air won't blow the filling tails of the selvage out of the warpwise thread. Without the baffle means, that is the result. The motive force provided by the venturi, including the rotary turbulence induced by the baffle means, prevents the waste selvage—even when the yarn is light—from wrapping around the draw-off wheels.

A method of removing waste selvage containing warp ends interlaced with filling tails from a shuttleless loom is also provided according to the invention. The method comprises the steps of: Disposing the venturi so that it is substantially downwardly directed and below the axis of rotation of the fabric take-up roller, and in operative association with waste selvage containing warp ends interlaced with filling tails trimmed and integrally drawn, from the fabric. Connecting up the exhaust from the loom impeller pump so that exhausting air from the pump provides the motive force for the venturi. Operating the pump and the venturi so that air exhausting from the pump forms a vacuum passing through the venturi to draw the waste selvage downwardly from the fabric take-up roller; and inducing rotary turbulence at the venturi to effect twisting of the filling tail and warp end or leno yarns of the waste selvage together.

It is the primary object of the present invention to provide a procedure for simple and energy efficient waste selvage removal from a loom, and one that may be easily applied to existing looms. This and other objects of the invention will become clear from an inspection of the detailed description of the invention, and from the appended claims.

DETAILED DESCRIPTION OF THE DRAWINGS

Figure 1:
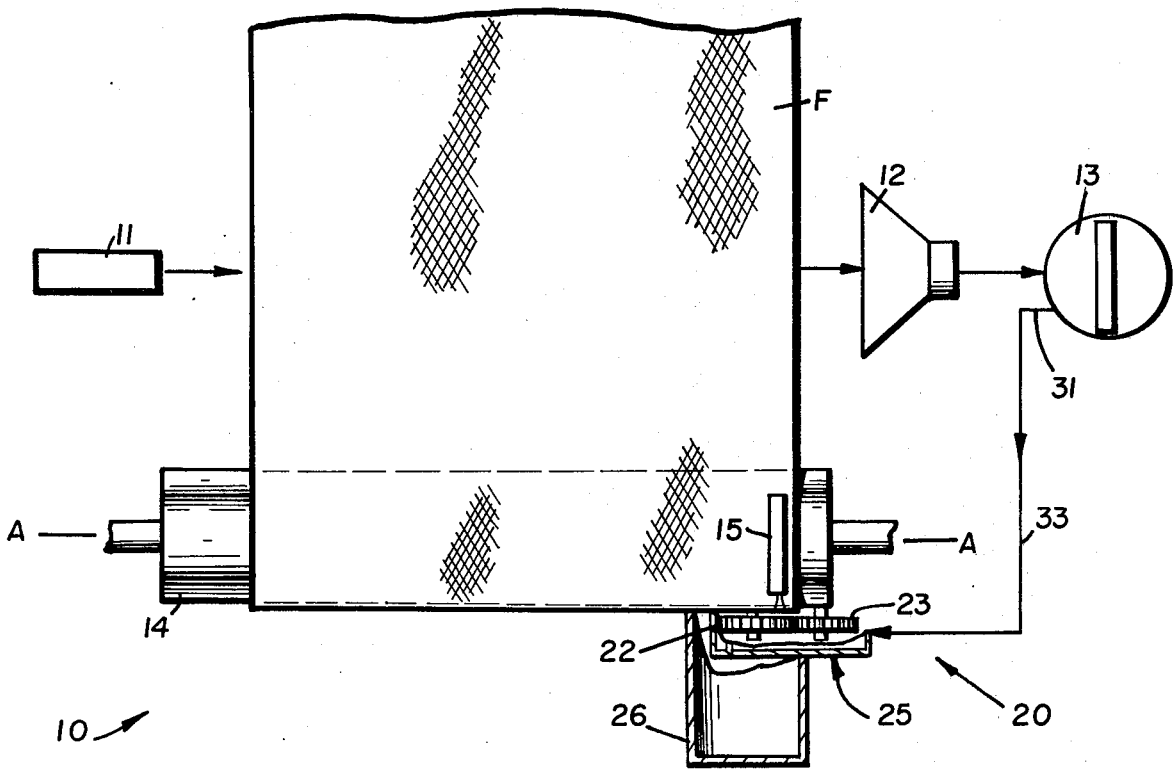
FIG. 1 is a top schematic view of a shuttleless loom utilizing a waste selvage removal means according to the invention.

A conventional shuttleless loom is illustrated generally by reference numeral 10 in FIG. 1. The loom includes an air jet 11 on one side thereof, a suction source 12 opposite the air jet 11 and powered by an impeller pump 13, and a fabric take-up roller 14 rotatable about a horizontal axis A—A. A selvage trimming mechanism 15 trims selvage from the fabric F edge. Other conventional components of the loom are not illustrated in FIG. 1.

According to the present invention, apparatus for removing waste selvage W containing warp ends or leno yarns interlaced with filling tails is shown generally by reference numeral 20. The removal means 20 may include the conventional pair of toothed draw-off wheels 22, 23 which are rotatable about horizontal axes perpendicular to the axis A—A, and which intermesh (see FIG. 2) to pull the waste selvage W downwardly from the roller 14 after the selvage has been trimmed by the trimmer 15. According to the present invention a venturi 25 is disposed so that it is substantially downwardly directed, and below the draw-off wheels 22, 23, exhausting into an open-top waste selvage container 26 which is disposed below it. The venturi 25 may be mounted to the frame for the loom 10, or to an accessory structure, in any manner desired, and can be mounted to the same support structure as the wheels 22, 23.

Figure 2:
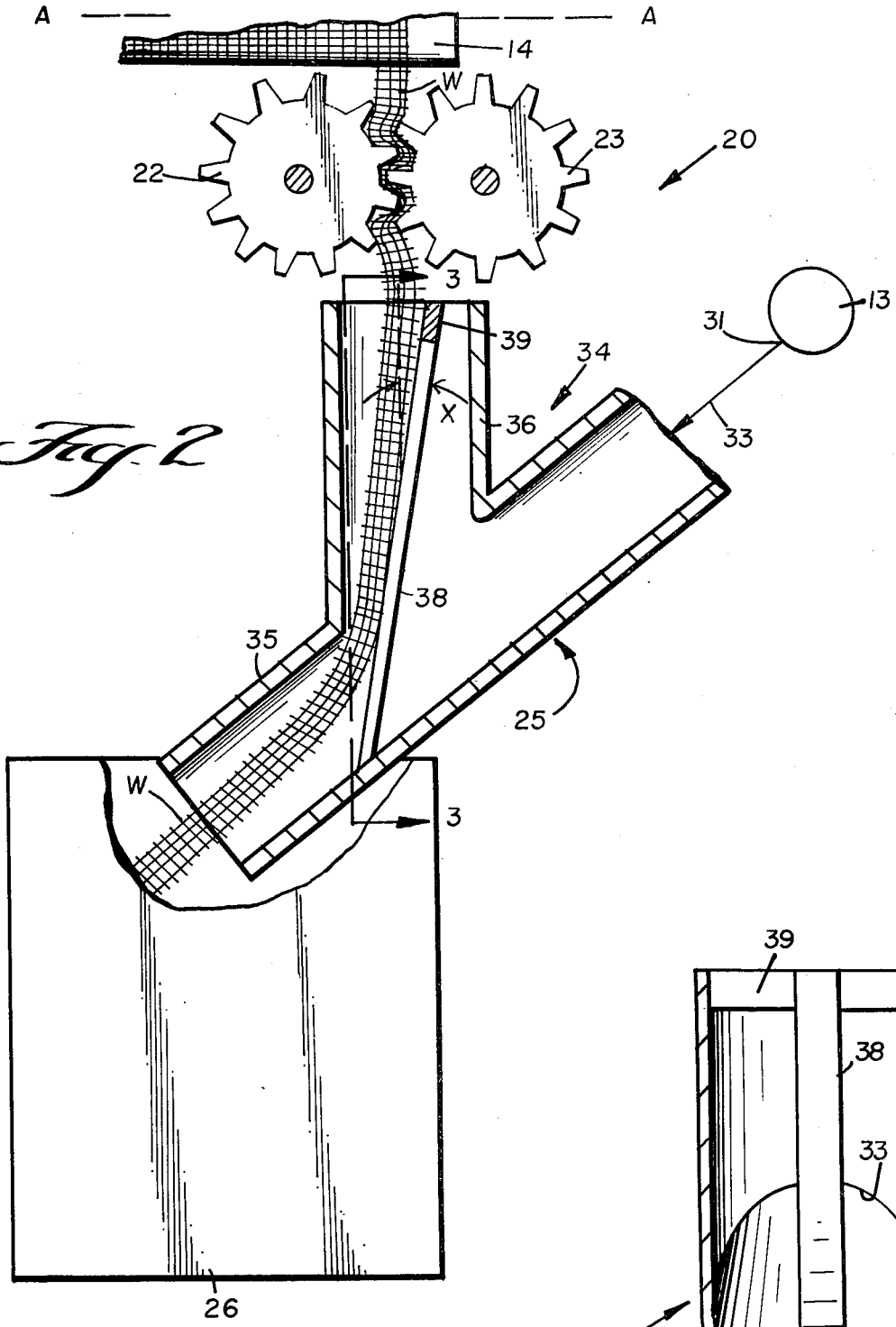
FIG. 2 is a side detail view, partly in elevation and partly in cross-section, of exemplary waste selvage removal apparatus according to the invention.

According to the present invention, exhaust conduit means extend from the exhaust port 31 of the impeller pump 13 to the venturi 25 to provide the motive power for the venturi to suck waste selvage W therethrough and deposit it in the container 26, as illustrated in FIG. 2. The exhaust conduit means preferably comprises a pneumatic line 33 extending from the exhaust port 31, and a branch connector 34 at the venturi 25. One branch 35 is an extension of line 33, and leads to container 26, while the other branch 36 extends upwardly to receive the waste selvage W from between the draw-off wheels 22, 23.

Figure 3:
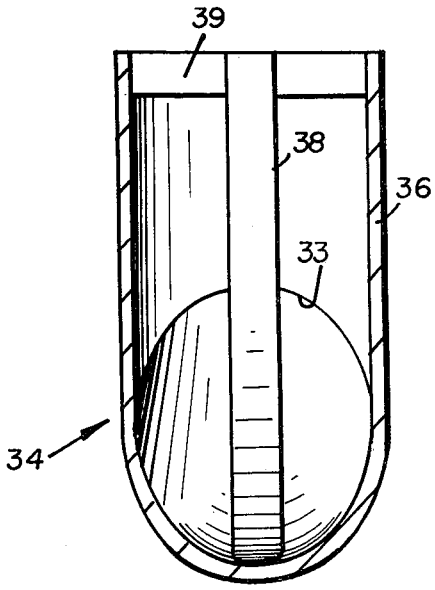
FIG. 3 is a cross-sectional view taken along lines 3—3 of FIG. 2.

The compressed air flowing through line 33 has a tendency to blow the waste selvage W back toward the draw-off wheels 22, 23, especially having a tendency to blow the filling tails out of the warp ends (or leno yarns) interlaced therewith. In order to prevent this undesirable effect, baffle means are provided according to the present invention for creating a rotary turbulence at the venturi 25 to twist the waste selvage W so that the filling tails and warp ends (or leno yarns) won't be expelled from the waste selvage W. The baffle means preferably comprises a thin strip of material 38 which is connected to the bottom of the venturi 25 (e.g. branch 35), as by a weld, with adhesive, or the like, and is connected to the top of the branch 36 by a cross piece 39 or the like. As seen in FIG. 3, preferably the strip of material 38 is relatively narrow with respect to the diameter of the branches 36, 36, e.g. the width of strip 38 being approximately ⅓ the inside diameter (cross-sectional width) of the branch 36. For instance where the branches 35, 36 (and line 33) have an inside diameter of about 1½ inches, the width of the baffle strip 38 is about ⅝ inch. As seen in FIG. 2, the strip 38 preferably makes a small angle X with respect to the vertical, however the baffle can also be completely in line with the vertical.

The compressed air passing through venturi 25 has rotary turbulence induced therein by the baffle strip 38, causing twisting of the filling tails and warp ends (or leno yarns) of the waste selvage W, and the exhaust from venturi 25 also facilitating proper disposition of the waste selvage W within the container 26.

While in the drawings the waste selvage removal mechanism 20 and associated waste selvage trimming device 15 are shown associated with only one edge of the fabric F, of course in practice sometimes a similar mechanism is provided on the opposite edge of the fabric F. The same pneumatic line 33 from the pump 13 may also be used to power the venturi for such second mechanism, if desired.

In a typical operation of the loom 10 utilizing the apparatus according to the invention, as the fabric F is formed, the selvage trimming mechanism 15 trims the edge of the fabric F, forming the waste selvage W. This selvage W moves over the periphery of the fabric take-up roller 14 and is drawn downwardly by the toothed take-up wheels 22, 23, and is passed into the open top of the branch 36 at venturi 25. The impeller pump 13 which provides the suction for the suction source 12, exhausts air through exhaust port 31, which passes through line 33 to venturi 25, to suck the selvage W downwardly into the container 26. The baffle strip 38 induces rotary turbulence in the air at venturi 25, causing the filling tails and warp ends or leno yarns to twist together. This action prevents the waste selvage W from wrapping around the draw-off wheels 22, 23, and deposits the waste selvage W in container 26.

It will thus be seen that according to the present invention a method and apparatus are provided which are simple and easy to utilize, yet effectively provide waste selvage removal. Waste selvage removal is accomplished with essentially no additional energy penalty, and the apparatus according to the invention may be easily retrofit onto existing shuttleless looms.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Apparatus for removing waste selvage containing warp ends or leno yarns interlaced with filling tails from a shuttleless loom, the loom including a suction source having an impeller pump with an exhaust, and a fabric take-up roller rotatable about a horizontal axis; comprising:

a substantially downwardly directed venturi mounted below said fabric take-up roller in operative association with waste selvage trimmed from fabric being taken up by the fabric take-up roller;

exhaust conduit means extending from said impeller pump exhaust to said venturi for providing the motive power for the venturi to suck waste selvage through the venturi and deposit it in said waste selvage container, including a branch connector at said venturi, one branch adapted to deposit waste selvage in a waste selvage receiving structure, and another branch receiving the waste selvage from the loom; and baffle means mounted in said branch connector for inducing rotary turbulence in exhaust air at said venturi so that filling tails and warp ends or leno yarns of the waste selvage twist together.

2. Apparatus as recited in claim 1 further comprising a pair of toothed draw-off wheels mounted between said fabric take-up roller and said another branch, in operative association with waste selvage from fabric being taken-up by the fabric take-up roller.

3. Apparatus as recited in claim 2 wherein said draw-off wheels are rotatable about horizontal axes perpendicular to the axis of rotation of said fabric take-up roller.

4. Apparatus as recited in claim 2 wherein said baffle means comprises a strip of material extending the length of said another branch of said exhaust conduit means and connected at the bottom thereof to said branch.

5. Apparatus as recited in claim 4 wherein said strip of material has a width approximately ⅓ the width of the cross-sectional area of said another branch.

6. Apparatus for disposing of waste selvage containing warp ends or leno yarns interlaced with filling tails from a shuttleless loom comprising:

a pair of toothed draw-off wheels for drawing-off waste selvage from the loom;

a compressed air line extending generally downwardly, and disposed below said draw-off wheels, including a venturi;

a branch connector at said venturi, including a first branch extending generally downwardly, and a second branch extending from an area adjacent the area between said draw-off wheels to said venturi; and a strip of material having a width less than the cross-sectional width of said second branch extending through said second branch and essentially in contact with said branch connector at the bottom thereof.

7. Apparatus as recited in claim 6 wherein said thin strip of material is connected to the branch at the bottom thereof, and is connected at the top thereof to said second branch by a cross piece.

8. Apparatus as recited in claims 6 or 7 wherein said thin strip of material has a width approximately ⅓ the cross-sectional width of said second branch.

9. A method of removing waste selvage containing warp ends or leno yarns interlaced with filling tails from a shuttleless loom, the loom including a suction source having an impeller pump with an exhaust, and a fabric take-up roller rotatable about a horiziontal axis; and utilizing a venturi; said method comprising the steps of:

disposing the venturi so that it is substantially downwardly directed, and below the axis of rotation of the fabric take-up roller, and in operative association with waste selvage containing warp ends or leno yarns interlaced with filling tails trimmed, and to be drawn, from the fabric;

connecting up the exhaust from the pump to the venturi so that exhausting air from the pump provides the motive force for the venturi; and inducing rotary turbulence at the venturi so that the filling tails and warp ends or leno yarns of the waste selvage will twist together as the waste selvage is being drawn downwardly by the venturi away from the fabric take-up roll.

10. A method as recited in claim 9 comprising the further step of providing a pair of toothed draw-off wheels rotatable about horizontal axes, disposed below the fabric take-up roller and above the venturi to work with the venturi to remove waste selvage.

11. Apparatus for disposing of waste selvage containing warp ends or leno yarns interlaced with filling tails from a shuttleless loom comprising:

a pair of toothed draw-off wheels for drawing-off waste selvage from the loom;

a compressed air line extending generally downwardly, and disposed below said draw-off wheels, including a venturi;

a branch connected connector at said venturi, including a first branch extending generally downwardly, and a second branch extending from an area adjacent the area between said draw-off wheels to said venturi; and baffle means mounted in said branch connector for inducing rotary turbulence in exhaust air at said venturi so that filling tails and warp ends or leno yarns of the waste selvage twist together.

12. Apparatus as recited in claim 11 wherein said draw-off wheels are rotatable about horizontal axes parallel to each other.

13. Apparatus as recited in claim 11 wherein said compressed air line is connected to the exhaust from an impeller pump.

14. Apparatus as recited in claim 12 wherein said compressed air line is connected to the exhaust from an impeller pump.

* * * * *